US005303479A

United States Patent [19]

Rudovsky

[11] Patent Number: 5,303,479

[45] Date of Patent: Apr. 19, 1994

[54] ADJUSTABLE VERTICAL AXIS ARCHERY BOW SIGHT MOUNT

[76] Inventor: Andrew T. Rudovsky, 124 Del Monte Dr., Pacifica, Calif. 94044

[21] Appl. No.: 877,548

[22] Filed: May 1, 1992

[51] Int. Cl.[5] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,271,863 | 9/1966 | Harrington | 33/265 |
| 3,284,904 | 11/1966 | Rade | 33/265 |
| 3,410,644 | 11/1968 | McLendon | 33/265 X |
| 3,822,479 | 7/1974 | Kowalski | 33/265 |
| 3,854,217 | 12/1974 | Killian | 33/265 |
| 4,635,374 | 1/1987 | Bradshaw | 33/265 |
| 5,072,716 | 12/1991 | Sappington | 33/265 X |

*Primary Examiner*—William A. Cuchlinski, Jr.
*Assistant Examiner*—C. W. Fulton
*Attorney, Agent, or Firm*—James J. Leary

[57] ABSTRACT

An archery bow sight mount that will allow desired bow sights to be attached to it and adjusted about the vertical axis. The bow sight mount is dovetailed so it can be slid into a mounting plate that is also dovetailed to allow it to be adjusted to desired length. On one end of the sight mount is a bow sight mounting plate that can be adjusted about the vertical axis by using adjustment screws.

16 Claims, 5 Drawing Sheets

ADJUSTABLE VERTICAL AXIS ARCHERY BOW SIGHT MOUNT

BACKGROUND

1. Field of Invention

This invention relates to sights for archery bows for use in hunting and tournament shooting, and more particularly to archery bow sights and sight mounts that include leveling devices that notify the archer when his shooting system is level.

2. Description of Prior Art

Sighting devices that use a leveling system when aiming a bow or archery shooting system are known and available for use in the art of archery. The leveling device is usually of the liquid filled glass tube type that relies on an air bubble suspended in the liquid to show when the leveling device is level. The leveling device is usually attached to the sight aperture so the archer can see both the level and the sighting index.

The leveling device allows the archer to assume that his bow is always perfectly vertical with respect to the longitudinal axis when he shoots the projectile (arrow) from the bow. Without the leveling device, the archer could lean or cant the bow to the left or right then causing the projectile to fly off course to the left or right.

Most archery bow sights have provisions for the adjustment of the sight aperture, that includes the leveling device, on the lateral and/or longitudinal axes. None have the capability to adjust the sight aperture about the vertical axis. This limitation is satisfactory as long as the bow is not going to be held in the uphill or downhill aiming position. However in most field archery tournaments and in hunting, uphill and downhill shooting is mandatory.

FIG. 4 shows the relationship of the vertical, lateral and longitudinal axes with respect to the archery bow.

FIG. 1 through FIG. 3 are diagrams that show the problems that arise if the sight aperture that includes the leveling device is not perpendicular (90 degrees) to the bow sight mounting arm with respect to the vertical axis when the bow is held in the uphill or downhill aiming position.

FIG. 1 shows what happens when the sight aperture and level are less than 90 degrees to the bow sight mounting arm with respect to the vertical axis. The archer draws his bow in the level position, looks at the sight aperture and sees the level as shown in FIG. 1*b*. At this point the bow is perfectly vertical and the level is indicating level. The archer then rotates his bow on the lateral axis and aims uphill. FIG. 1*a* shows what the level indicates to the archer when the bow is perfectly vertical about the longitudinal axis. Because the archer is relying on the level to notify him when his bow is perfectly level, he assumes that the level is correct, and rotates the bow about the longitudinal axis until the air bubble shows level. He has made the level indicate a level position, but in order to do this, he had to rotate the bow about the longitudinal axis and now the bow is not perfectly vertical but slightly canted to the right. This will cause the projectile to shoot slightly to the right. If the archer aims the bow downhill, the level will indicate what is shown in FIG. 1*c*. The same errors will occur as stated above only in reverse order.

FIG. 2 shows what happens when the sight aperture and level are greater than 90 degrees to the bow sight mounting arm with respect to the vertical axis. The archer draws his bow in the level position, looks at the sight aperture and sees the level as shown in FIG. 2*b*. At this point the bow is perfectly vertical and the level is indicating level. The archer then rotates his bow on the lateral axis and aims uphill. FIG. 2*a* shows what the level indicates to the archer when the bow is perfectly vertical about the longitudinal axis. Because the archer is relying on the level to notify him when his bow is perfectly level, he assumes that the level is correct, and rotates the bow about the longitudinal axis until the air bubble shows level. He has made the level indicate a level position, but in order to do this, he had to rotate the bow about the longitudinal axis and now the bow is not perfectly vertical but slightly canted to the left. This will cause the projectile to shoot slightly to the left. If the archer aims the bow downhill, the level will indicate what is shown in FIG. 2*c*. The same errors will occur as stated above only in reverse order.

FIG. 3 shows when the sight aperture is exactly 90 degrees to the bow sight mounting arm with respect to the vertical axis. Whether the archer is aiming the bow uphill, FIG. 3*a*, level, FIG. 3*b*, or downhill, FIG. 3*c*, the bow always stays perfectly level about the longitudinal axis.

Because there is no bow sight or bow sight mount available to satisfy the problems addressed above, the archer at the present time has to bend the threads on the sight aperture with needle nose pliers or other suitable tools, forward and backwards, until the aperture is 90 degrees to the bow sight mounting arm with respect to the vertical axis. This practice has several disadvantages such as:

1. The metal threads become brittle from bending them back and forth and break.
2. Other adjustments made to the sight become out of alignment because of the stresses placed on them during the bending process.
3. It is very difficult to adjust the sight exactly.
4. The metal in the threads tends to seek its original position.
5. The archer could slip with the tools and cause damage to the sight.

OBJECTS AND ADVANTAGES

In its basic concept, this invention provides an archery bow sight mount in which any bow sight can be attached and be adjusted about the vertical axis.

DESCRIPTION OF DRAWINGS

In the drawings, closely related figures have the same number but different alphabetical suffixes.

REFERENCE NUMERALS IN DRAWINGS

Figure 1:
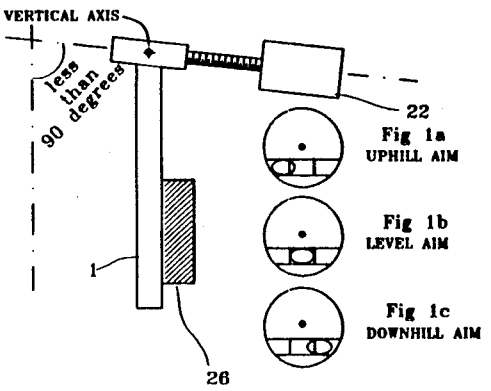
FIG. 1 is a diagram that shows a leveling device's positions if aiming aperture is less than 90 degrees to the bow sight mounting arm with respect to the vertical axis.
Figure 2:
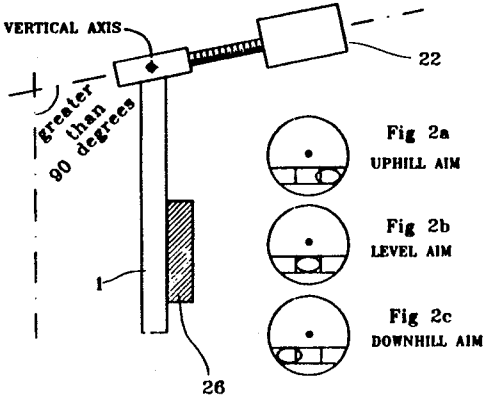
FIG. 2 is a diagram that shows a leveling device's positions if the aiming aperture is more than 90 degrees to the bow sight mounting arm with respect to the vertical axis.
Figure 3:
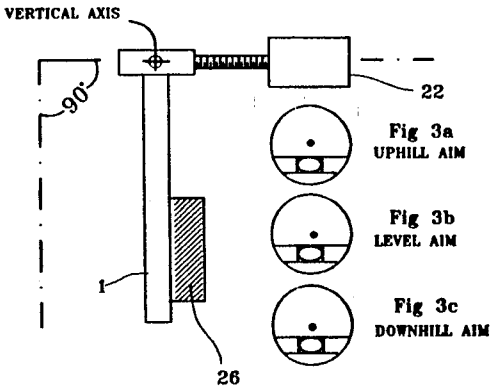
FIG. 3 is a diagram that shows a leveling device's positions if the aiming aperture is exactly 90 degrees to the bow sight mounting arm with respect to the vertical axis.
Figure 4:
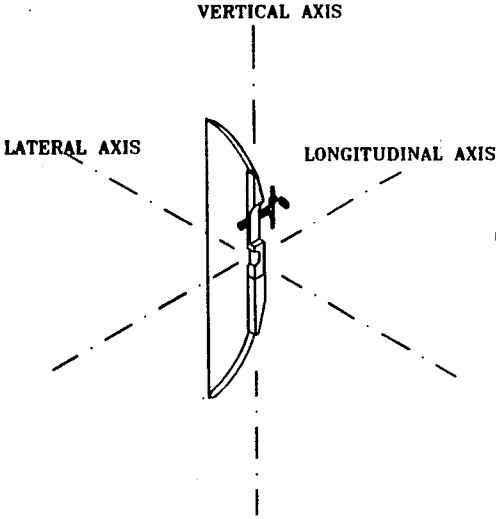
FIG. 4 is a perspective view of the lateral, vertical and longitudinal axes with respect to an archery bow.
Figure 5:
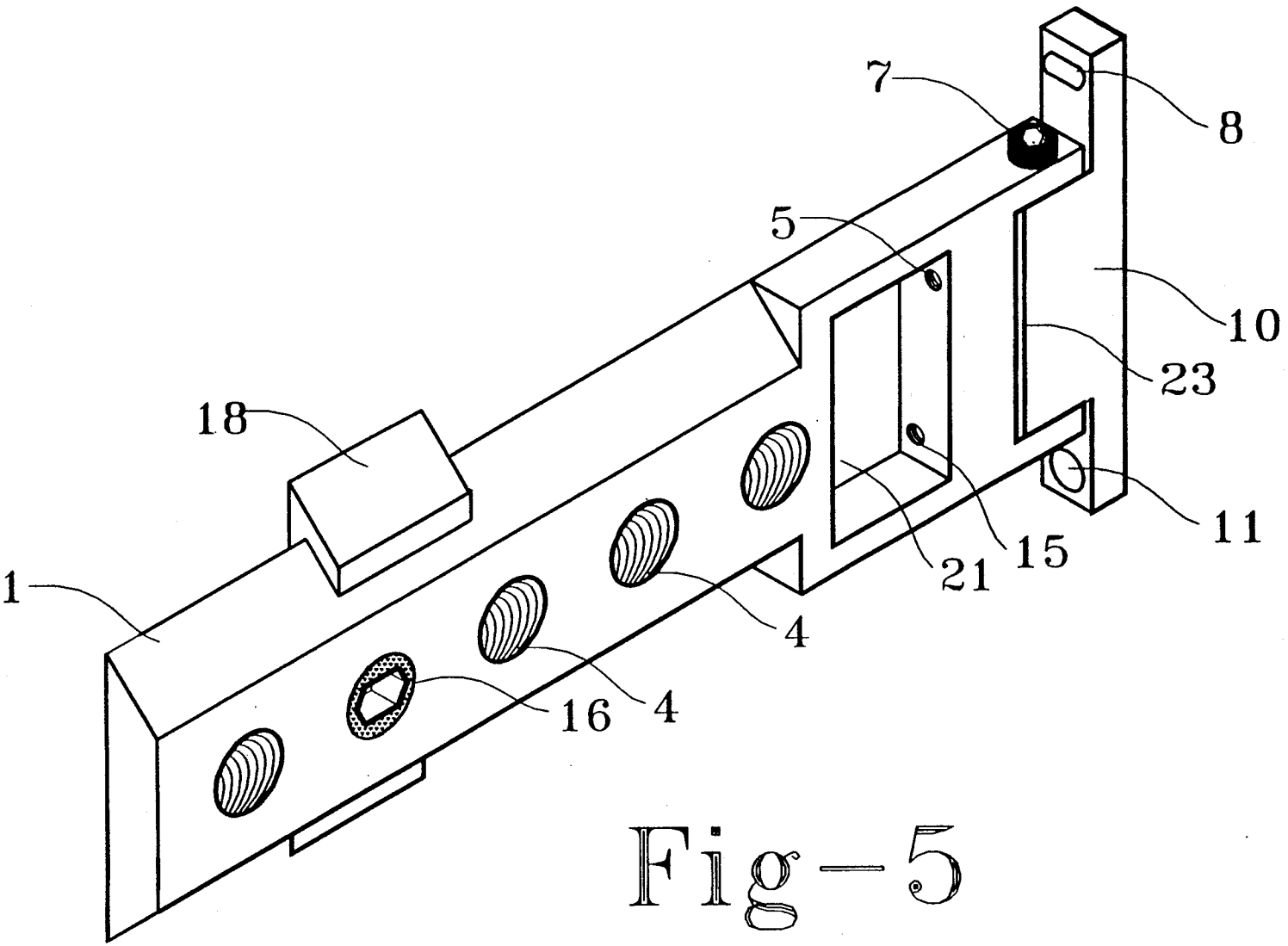
FIG. 5 is an isometric view of an archery bow sight mount embodying the features of this invention.

| | |
|---|---|
| 1 | mounting arm |
| 2 | set screw |
| 3 | 4 degree spotface |
| 4 | threaded bores |
| 5 | threaded bore |
| 6 | bore |
| 7 | cap screw |
| 8 | elongated bore |
| 9 | bore |
| 10 | adjustable sight mounting plate |
| 11 | bore |
| 12 | bore |
| 13 | washer |
| 14 | lock nut |
| 15 | threaded bore |
| 16 | set screw |
| 17 | screws |
| 18 | bow handle mounting plate |
| 19 | countersunk bore |
| 20 | slot |
| 21 | void |
| 22 | sight aperture with leveling device |
| 23 | 1/32 inch space |
| 24 | leveling device |
| 25 | bow sight |
| 26 | archery bow riser |

DESCRIPTION OF THE PREFERRED EMBODIMENTS

The bow sight mounting arm 1 of this invention includes a bow handle mounting plate 18 arranged to be anchored, as by screws 17 extending through openings 19 in the plate, in a desired position on the bow handle. The mounting plate 18 includes a centrally located dovetail slot arranged to slidably receive an elongated mounting arm 1 having a corresponding dovetail cross section.

The mounting arm 1 includes a plurality of longitudinally spaced, threaded bores 4 that, in cooperation with a set screw 16, provide means for releasably securing the arm to the mounting plate in various positions of longitudinal extension.

On the end of the mounting arm 1 a slot 20 is machined to receive the adjustable sight mounting plate 10 that is machined to fit into slot 20. The surface of the adjustable sight mounting plate that faces slot 20 is held a distance 23 away from the slot face and bored 9. The adjustable sight mounting plate is pinned in position by the cap screw 7 that goes through bores 6, 9, and 12 and also acts as a hinge. The adjustable sight mounting plate has bore 11 and elongated bore 8 to allow a bow sight device to be attached and adjusted about the longitudinal axis.

Figure 10:
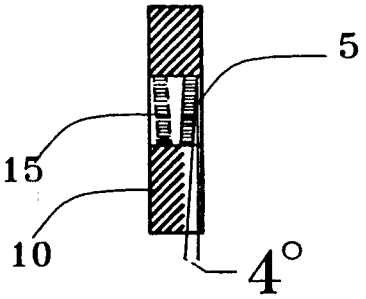
FIG. 10 is a cut view through FIG. 9 showing angled drillings and tappings of bores.
Figure 8:
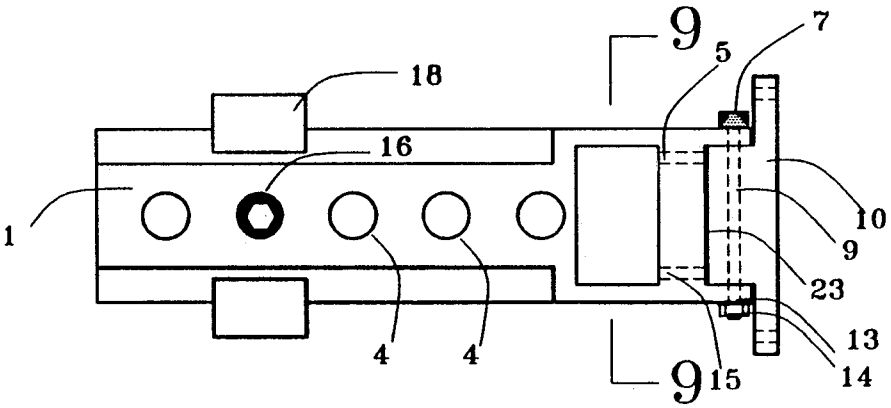
FIG. 8 is a plan view of the invention.

Behind the cap screw 7 a void 21 is machined through the mounting arm to allow access to the tapped bore 5 that is bored on a 4 degree angle and tapped bore 15 that is bored on a negative 4 degree angle as shown in FIG. 10.

Figure 6:
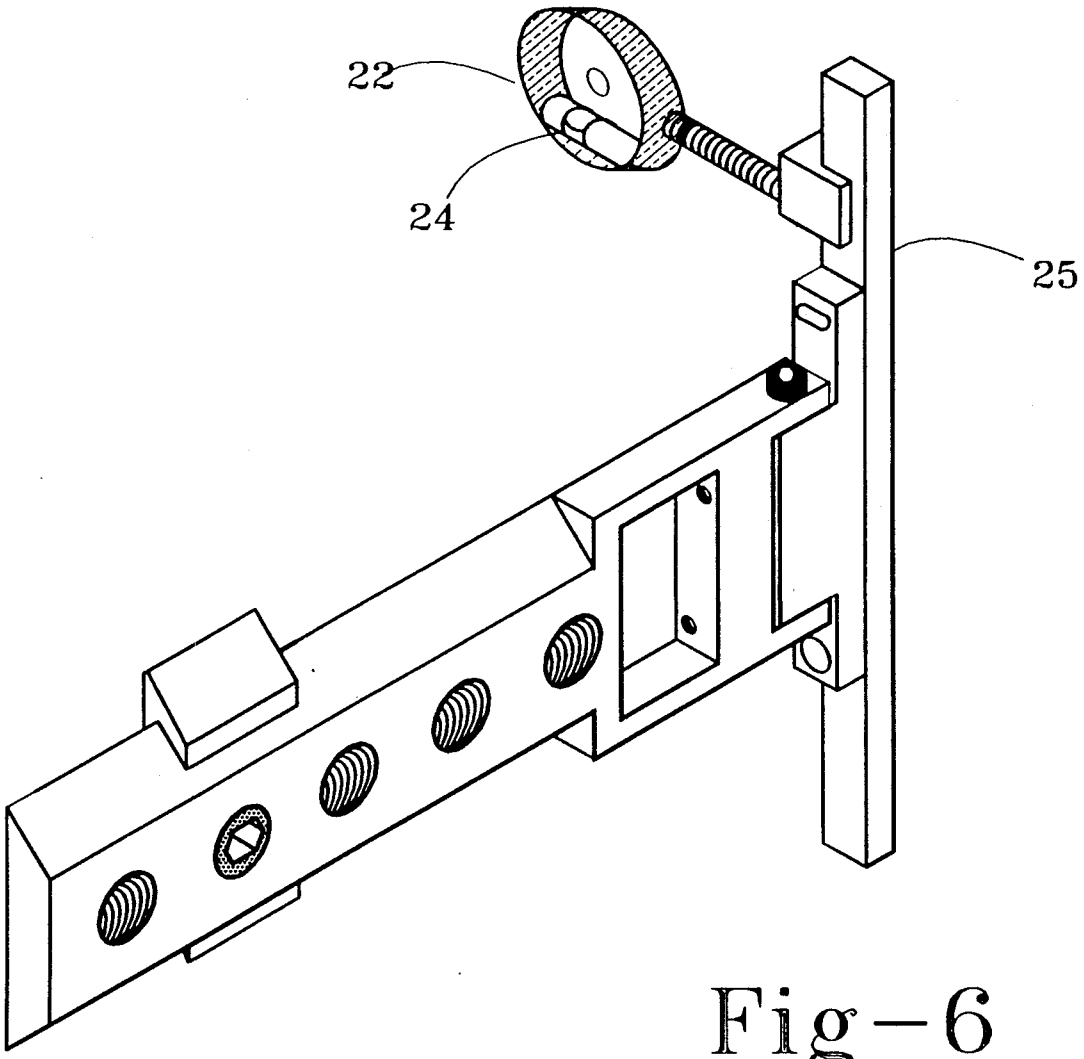
FIG. 6 is an isometric view of this invention showing a bow sighting device with level attached to invention.
Figure 7:
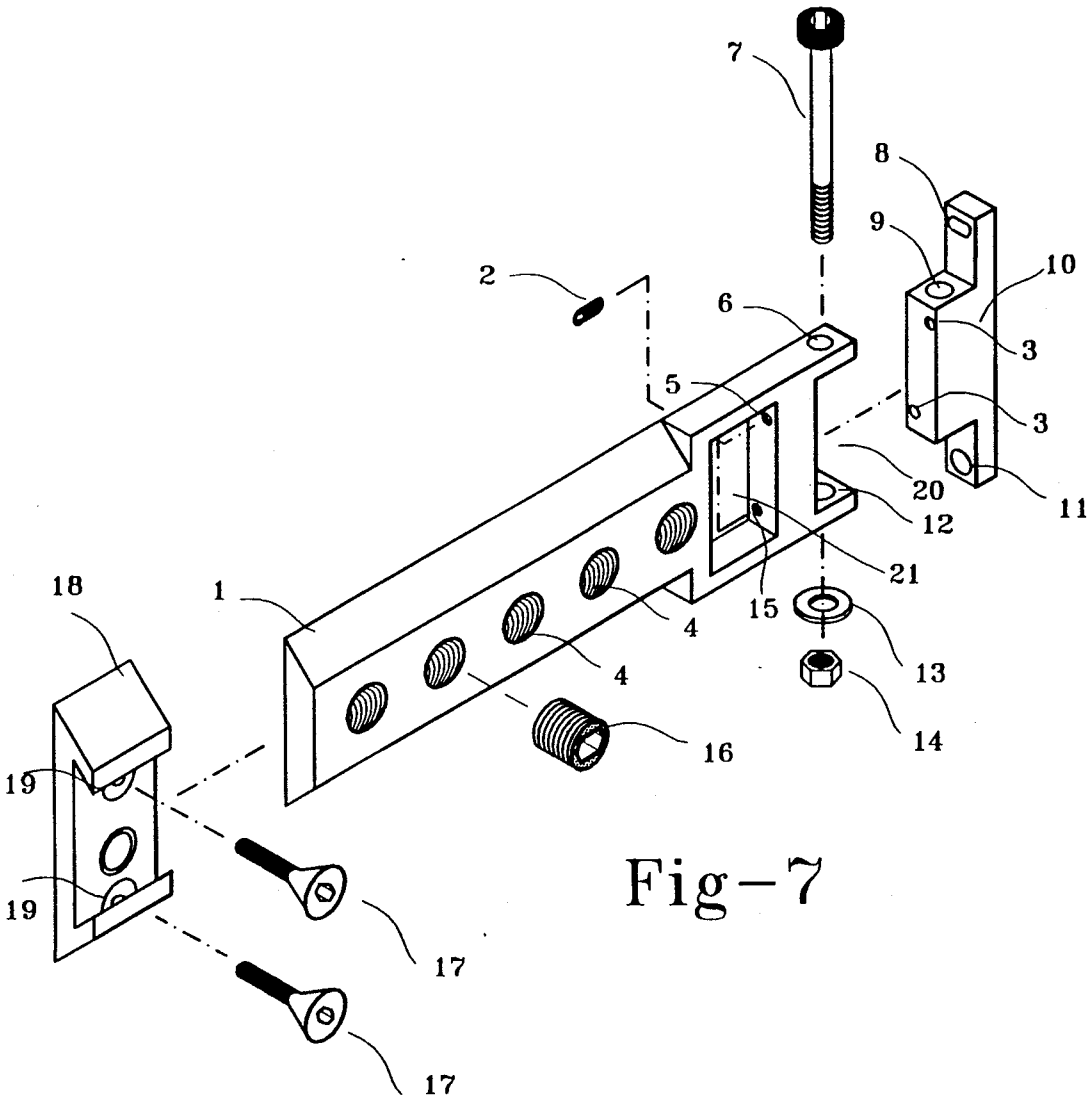
FIG. 7 is an exploded view of the invention.
Figure 9:
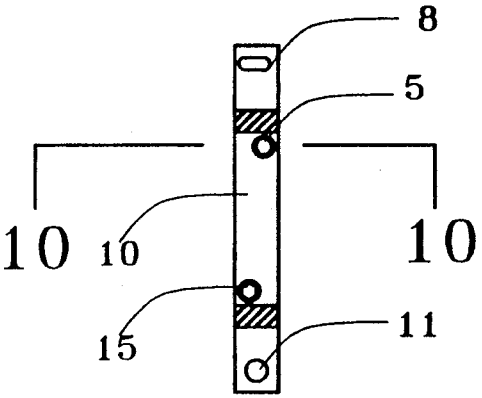
FIG. 9 is a cut view through FIG. 8 showing offset drillings and tapping to accept screws.

It is an important feature of this invention that a set screw 2 is inserted into each of the tapped bores 5 and 15 and that they contact the surface of the adjustable sight mounting plate at the 4 degree spotfaces 3. The set screws 2 have Allen sockets that allow them to be adjusted clockwise or counterclockwise whereby forcing the adjustable sight mounting plate to rotate about the vertical axis. After the aiming aperture 22 that has a leveling device 24 attached, as illustrated in FIG. 6, is positioned at a 90 degree angle to the bow sight mounting arm 1 with respect to the vertical axis the lock nut 14 is secured whereby holding the adjustable sight mounting plate in position.

OPERATION

The bow handle mounting plate 18 is attached to the bow handle by two screws 17 and then the mounting arm 1 is slid into the position of desired length and fastened by the set screw 16. The desired archery bow sight is attached to the adjustable sight mounting plate through bores 8 and 11. The archery bow is then placed in a readily available archery bow jig that will allow it to be rotated about the longitudinal and lateral axes. The bow is first made level with respect to the longitudinal axis by moving it with the bow jig adjustments. Then the bow is made level with respect to the lateral axis by moving it with the bow jig adjustments. The bow sight is made level by using bore 11 and the elongated bore 8 on the adjustable sight mounting plate 10. The desired leveling device is now installed onto the bow sight and leveled with respect to the lateral axis. All the adjustments made so far are the normal setup procedures that an archer has to do before he can use a leveling device effectively. Now the bow is rotated to the uphill aiming position by using the jig. The locknut 14 is loosened and the adjustment screws 2 are adjusted until the leveling device shows that it is level. The bow is now turned down to the downhill aiming position and the adjustment screws 2 are again adjusted if necessary. This procedure is done until the leveling device is showing level in the uphill and downhill aiming positions. The locknut 14 is then tightened. The bow will now be vertical with respect to the longitudinal axis when the leveling device indicates a level position.

SUMMARY

Accordingly, the reader will see that the archery adjustable sight mount can be very useful to an archer. In the art of tournament archery an arrow that is just out of the scoring ring can be all that it takes to win or loose a tournament. This invention can eliminate missed arrows that were caused by archery equipment setup errors and not by the archer's aiming techniques.

It will be apparent to those skilled in the art that various changes may be made in the size, shape, type, material, number and arrangement of parts described herein before without departing from the spirit of this invention and the scope of the appended claims.

Having now described my invention and the manner in which it may be used I claim:

1. A mounting device for mounting an archery bow sight of the type comprising a leveling device onto an archery bow, said mounting device comprising:

a horizontal mounting arm having a proximal end and a distal end, said distal end of said mounting arm having a pivot means which has a vertical axis of rotation, a bow sight mounting plate having means for attachment to said bow sight, said mounting plate being pivotally attached to said distal end of said mounting arm by said pivot means, and a means for attaching said mounting arm to an archery bow, wherein said bow sight mounting plate has a planar surface oriented parallel to said vertical axis of said pivot means and an attachment means for attaching said bow sight to said planar surface such that said bow sight is mounted in an orientation parallel to said vertical axis of said pivot means.

2. The bow sight mounting device of claim 1, wherein said pivot means further comprises an adjustment means for adjusting the angular orientation of said bow sight mounting plate with respect to said mounting arm.

3. The bow sight mounting device of claim 1, wherein said pivot means further comprises a locking means for changeably fixing the position of said bow sight mounting plate with respect to said mounting arm in a selected angular orientation.

4. The bow sight mounting device of claim 3, wherein said locking means comprises a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm, whereby when said first set screw and said second set screw are simultaneously tightened said bow sight mounting plate may be fixed in a selected angular orientation with respect to said mounting arm.

5. The bow sight mounting device of claim 1, wherein said pivot means further comprises an adjustment means for adjusting the angular orientation of said bow sight mounting plate with respect to said mounting arm and a locking means for fixing the position of said bow sight mounting plate with respect to said mounting arm in a selected angular orientation.

6. The bow sight mounting device of claim 1, wherein said means for attaching said mounting arm to an archery bow comprises a bow handle mounting plate attached to said archery bow, said bow handle mounting plate having a dovetail slot there through and said proximal end of said mounting arm having a matching dovetail profile such that said proximal end of said mounting arm may be slidably received in said dovetail slot, and a mounting arm locking means for changeably fixing the position of said mounting arm with respect to said bow handle mounting plate.

7. A mounting device for mounting an archery bow sight of the type comprising a leveling device onto an archery bow, said mounting device comprising:

a horizontal mounting arm having a proximal end and a distal end, said distal end of said mounting arm having a pivot means which has a vertical axis of rotation, a bow sight mounting plate having means for attachment to said bow sight, said mounting plate being pivotally attached to said distal end of said mounting arm by said pivot means, and a means for attaching said mounting arm to an archery bow, wherein said pivot means comprises an adjustment means for adjusting the angular orientation of said bow sight mounting plate with respect to said mounting arm, said adjustment means comprising a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm.

8. A mounting device for mounting an archery bow sight of the type comprising a leveling device onto an archery bow, said mounting device comprising:

a horizontal mounting arm having a proximal end and a distal end, said distal end of said mounting arm having a pivot means which has a vertical axis of rotation, a bow sight mounting plate having means for attachment to said bow sight, said mounting plate being pivotally attached to said distal end of said mounting arm by said pivot means, said bow sight mounting plate having a planar surface oriented parallel to said vertical axis of said pivot means and an attachment means for attaching said bow sight to said planar surface such that said bow sight is mounted in an orientation parallel to said vertical axis of said pivot means, a pivot adjustment means for adjusting the angular orientation of said bow sight mounting plate with respect to said mounting arm, a pivot locking means for changeably fixing the position of said bow sight mounting plate with respect to said mounting arm in a selected angular orientation and a means for attaching said mounting arm to an archery bow.

9. The bow sight mounting device of claim 8, wherein said pivot locking means comprises a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm, whereby when said first set screw and said second set screw are simultaneously tightened said bow sight mounting plate may be fixed in a selected angular orientation with respect to said mounting arm.

10. A mounting device for mounting an archery bow sight of the type comprising a leveling device onto an archery bow, said mounting device comprising:

a horizontal mounting arm having a proximal end and a distal end, said distal end of said mounting arm having a pivot means which has a vertical axis of rotation, a bow sight mounting plate having means for attachment to said bow sight, said mounting plate being pivotally attached to said distal end of said mounting arm by said pivot means, a pivot adjustment means for adjusting the angular orientation of said bow sight mounting plate with respect to said mounting arm, a pivot locking means for changeably fixing the position of said bow sight mounting plate with respect to said mounting arm in a selected angular orientation and a means for attaching said mounting arm to an archery bow, wherein said pivot adjustment means comprises a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm.

11. In combination:

an archery bow having vertical, lateral and longitudinal axes, a bow sight which comprises a leveling device, and a bow sight mounting device, comprising:

a horizontal mounting arm having a proximal end and a distal end, said distal end of said mounting arm having a pivot means which has a vertical axis of rotation, a bow sight mounting plate, said mounting plate being pivotally attached to said distal end of said mounting arm by said pivot means, said bow sight mounting plate having a planar surface oriented parallel to said vertical axis of said pivot means and an attachment means for attaching said bow sight to said planar surface such that said bow sight is mounted in an orientation parallel to said vertical axis of said pivot means, and a means for attaching said mounting arm to an archery bow, wherein said pivot means of said bow sight mounting device allows the angular orientation of said bow sight with respect to said archery bow to be adjusted to a position where said leveling device is oriented perpendicular to a plane defined by said vertical axis and said longitudinal axis of said bow, whereby when said leveling device indicates a level condition, said plane will be in a vertical orientation regardless of any upward or downward inclination of said longitudinal axis of said bow.

12. The combination of claim 11, wherein said pivot means further comprises an adjustment means for adjusting the angular orientation of said bow sight mounting plate with respect to said mounting arm.

13. The combination of claim 11, wherein said pivot means further comprises a locking means for changeably fixing the position of said bow sight mounting plate with respect to said mounting arm in a selected angular orientation.

14. The combination of claim 13, wherein said locking means comprises a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm, whereby when said first set screw and said second set screw are simultaneously tightened said bow sight mounting plate may be fixed in a selected angular orientation with respect to said mounting arm.

15. The combination of claim 11, wherein said pivot means further comprises an adjustment means for adjusting the angular orientation of said bow sight mounting plate with respect to said mounting arm and a locking means for fixing the position of said bow sight mounting plate with respect to said mounting arm in a selected angular orientation.

16. In combination:

an archery bow having vertical, lateral and longitudinal axes, a bow sight which comprises a leveling device, and a bow sight mounting device, comprising:

a horizontal mounting arm having a proximal end and a distal end, said distal end of said mounting arm having a pivot means which has a vertical axis of rotation, a bow sight mounting plate having means for attachment to said bow sight, said mounting plate being pivotally attached to said distal end of said mounting arm by said pivot means, and a means for attaching said mounting arm to an archery bow, wherein said pivot means of said bow sight mounting device allows the angular orientation of said bow sight with respect to said archery bow to be adjusted to a position where said leveling device is oriented perpendicular to a plane defined by said vertical axis and said longitudinal axis of said bow, whereby when said leveling device indicates a level condition, said plane will be in a vertical orientation regardless of any upward or downward inclination of said longitudinal axis of said bow, wherein said adjustment means comprises a first set screw which, when rotated, will urge said bow sight mounting plate to rotate about said vertical axis of said pivot means in a clockwise direction with respect to said mounting arm and a second set screw which, when rotated, will urge said bow sight mounting plate to rotate about said vertical axis of said pivot means in a counterclockwise direction with respect to said mounting arm.

* * * * *